US007040377B2

(12) United States Patent
Toyoshima et al.

(10) Patent No.: US 7,040,377 B2
(45) Date of Patent: May 9, 2006

(54) INJECTION SYSTEM AND CASTING METHOD OF DIE CASTING MACHINE

(75) Inventors: Toshiaki Toyoshima, Kanagawa (JP); Yuji Abe, Kanagawa (JP); Hiroshi Yokoyama, Kanagawa (JP); Makoto Tsuji, Kanagawa (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/840,507

(22) Filed: May 7, 2004

(65) Prior Publication Data

US 2005/0028961 A1 Feb. 10, 2005

(30) Foreign Application Priority Data

May 9, 2003 (JP) ..... 2003-131714

(51) Int. Cl.
*B22D 17/22* (2006.01)

(52) U.S. Cl. ..... 164/155.1; 164/457

(58) Field of Classification Search ..... 164/457, 164/155.1, 113
See application file for complete search history.

(56) References Cited

U.S. PATENT DOCUMENTS 5,207,267 A * 5/1993 Iwamoto et al. ..... 164/457
5,299,626 A * 4/1994 Iwamoto ..... 164/457
5,662,159 A * 9/1997 Iwamoto et al. ..... 164/457
5,957,192 A * 9/1999 Kitamura et al. ..... 164/457
5,988,260 A * 11/1999 Iwamoto et al. ..... 164/457
6,241,003 B1 * 6/2001 Kodama et al. ..... 164/457
6,450,240 B1 * 9/2002 Kodama et al. ..... 164/457
6,629,558 B1 * 10/2003 Tsuji ..... 164/314

* cited by examiner

*Primary Examiner*—Len Tran
(74) *Attorney, Agent, or Firm*—Pillsbury Winthrop Shaw Pittman LLP

(57) ABSTRACT

An injection system of a die casting machine giving the necessary casting pressure without adjusting the accumulator side, provided with an injection cylinder including an injection piston linked with the injection plunger and a booster piston arranged behind the injection piston, an accumulator for supplying a pressurized liquid of a predetermined pressure, a liquid pressure circuit for supplying the pressurized liquid from the accumulator to the injection cylinder, driving the injection piston, then driving the booster piston, a control valve for controlling a flow rate of the pressurized liquid discharged from the front side of the injection piston of the injection cylinder so as to control a flow rate of the injection piston, and controlling the pressure of the pressurized liquid at the front side of the injection piston by the timing of closing the control valve to determine the final value of the casting pressure.

4 Claims, 2 Drawing Sheets

INJECTION SYSTEM AND CASTING METHOD OF DIE CASTING MACHINE

BACKGROUND OF THE INVENTION

1. Field of the Invention

The present invention relates to an injection system and casting method of a die casting machine method.

2. Description of the Related Art

In a die casting machine, an injection plunger is used to inject a molten metal into a cavity of a die by an injection plunger. The quality of the cast product greatly depends upon the injection speed of the molten metal and the casting pressure (injection pressure). Therefore, it is necessary to suitable control the speed of movement (injection speed) and pressure of the injection cylinder driving the injection plunger. That is, the injection speed and the casting pressure (injection pressure) are controlled in accordance with the state of filling the molten metal between the casting cycles to realize the optimal injection operation.

For example, in a predetermined zone after the start of injection, the injection plunger is made to move by a low injection speed so that the molten metal in the injection sleeve does not enter air. Next, when the front end of the molten metal reaches the inlet of the cavity, the injection speed is switched from low speed to high speed to make the injection plunger move by a high injection speed so as to complete the filling of the molten metal into the cavity before the molten metal cools and solidifies. After the molten metal finishes being filled into the cavity, the casting pressure (injection pressure) is rapidly increased and the molten metal is allowed to solidify while applying pressure to the molten metal in the cavity.

The casting pressure finally output after the injection system injects and fills molten metal into the cavity of the die and increases the casting pressure is usually determined in accordance with the pressure of the pressurized oil supplied from the accumulator. The accumulator includes a piston. A gas chamber is formed at one side of the piston. The gas chamber is for example filled with nitrogen gas or another pressure-accumulating gas whereby the pressure is accumulated. For example, by the input and output of the pressurized oil to and from the gas chamber, the volume of the gas chamber can be changed and the pressure accumulated in the accumulator can be adjusted.

On the other hand, the casting pressure differs in accordance with the product concerned (die). Further, it differs depending on the casting conditions even for the same die. Therefore, if exchanging the dies or changing the casting conditions, it is necessary to adjust the pressure setting of the accumulator in accordance with this. The range of adjustment of the pressure of the accumulator depends on the pressure of the pressure-accumulating gas filled in the gas chamber. Therefore, when the changed casting pressure is outside of the range of adjustment of the pressure of the accumulator, the pressure-accumulating gas filled in the gas chamber has to be discharged or charged. To obtain an accurate casting pressure, it is necessary to calculate the amount of the gas filled in the gas chamber. If the gas filled in the gas chamber leaks, the casting pressure will fluctuate, so it was necessary to calculate the amount of gas frequently. In this way, it was necessary to adjust the pressure of the accumulator due to changes in the casting pressure. This work required time. Further, adjustment of the pressure of the accumulator required the discharge or discharge of the nitrogen gas, so there was also the disadvantage of the higher cost.

SUMMARY OF THE INVENTION

An object of the present invention is to provide an injection system and casting method of a die casting machine giving a required casting pressure without adjusting the accumulator side even if the injection system has to change the finally output casting pressure due to the exchange of dies or changes in the casting conditions.

According to a first aspect of the invention, there is provided an injection system of a die casting machine for moving forward an injection plunger to inject and fill a molten metal in a cavity formed in a die and raising the casting pressure of the molten metal filled in the cavity for casting, the injection system of a die casting machine comprising an injection cylinder including an injection piston linked with the injection plunger and a booster piston arranged behind the injection piston, an accumulator for supplying a pressurized liquid of a predetermined pressure, a liquid pressure circuit for supplying the pressurized liquid from the accumulator to the injection cylinder, driving the injection piston, then driving the booster piston, a control valve for controlling a flow rate of the pressurized liquid discharged from the front side of the injection piston of the injection cylinder so as to control a flow rate of the injection piston, and a control means for controlling the pressure of pressurized liquid at the front side of the injection piston by the timing of closing the control valve to determine the final value of the casting pressure.

Preferably, the injection system of the die casting machine of the present invention comprises a first pressure detecting means for detecting the pressure of the pressurized liquid at the front of the injection piston and a second pressure detecting means for detecting the pressure of the pressurized liquid at the back of the injection piston, and the control means determines the timing of closing the control valve based on the pressure of the pressurized liquid detected by the first and second pressure detecting means.

More preferably, the booster piston has a first piston part with a cross-sectional area approximately equal to the injection piston and a second piston with a diameter larger than the first piston part, the injection cylinder has a first cylinder chamber where the injection piston and the first piston part of the booster piston can slide together and a second cylinder chamber wherein the second piston part of the booster piston can slide, the pressurized liquid is supplied between the injection piston of the first cylinder chamber and the first piston part of the booster piston whereby the injection piston is driven, and the pressurized liquid is supplied behind the second piston part of the booster piston of the second cylinder chamber whereby the booster piston is driven.

More preferably, a front side of the injection piston of the first cylinder chamber and a front side of the second piston of the second cylinder chamber are communicated.

According to a second aspect of the invention, there is provided a casting method for moving forward an injection plunger to inject and fill a molten metal in a cavity formed in a die and raising the casting pressure of the molten metal filled in the cavity for casting, the casting method comprising supplying a pressurized liquid of a predetermined pressure from an accumulator to behind an injection piston positioned in an injection cylinder for driving the injection plunger, controlling the injection piston by controlling a flow rate of the pressurized liquid discharged from the front side of the injection piston by a control valve, driving a booster piston positioned behind the injection piston of the injection cylinder to raise the casting pressure when the cavity is injected and filled by molten metal, and controlling the pressure of the pressurized liquid at the front side of the injection piston by the timing of closing the control valve to determine the final value of the casting pressure.

Preferably, the casting method of the present invention detects the pressure of the pressurized liquid at the front side of the injection piston and the pressure of the pressurized liquid behind the injection piston and determines the timing of closing the control valve based on the pressure of the pressurized liquid.

In the present invention, first, the pressurized liquid of a predetermined pressure is supplied from the accumulator through the liquid pressure circuit to the injection cylinder whereby the injection piston is driven. Due to the advance of the injection piston, the pressurized liquid is discharged from the injection cylinder. By adjusting the flow rate of the discharged the pressurized liquid by the control valve, the speed of the injection piston is controlled. By the advance of the injection piston, the cavity of the die is injected and filled with the molten metal. When the cavity is filled with the molten metal, the injection piston rapidly decreases in speed.

The booster piston is driven and the pressure inside the die cavity, that is, the casting pressure, rises. Further, the pressure of the pressurized liquid at the front side of the injection piston descends along with the deceleration and stopping of the injection piston. Further, the pressure of the pressurized liquid at the back of the injection piston rises.

On the other hand, the casting pressure is determined by the pressure of the pressurized liquid at the front side of the injection piston and the pressure of the pressurized liquid at the back side of the injection piston.

If closing the control valve while the pressure of the pressurized liquid at the front side of the injection piston is descending, the pressure of the pressurized liquid at the front side of the injection piston is held at the value at the time of closing the control valve. The final casting pressure is defined by this.

The present invention suitably determines the timing for closing the control value so as to control the pressure of the front side of the injection piston and determine the final value of the casting pressure. Therefore, adjustment of the pressure at the accumulator side is no longer necessary.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Preferred embodiments of the present invention will be described in detail below with reference to the accompanying drawings.

Figure 1:
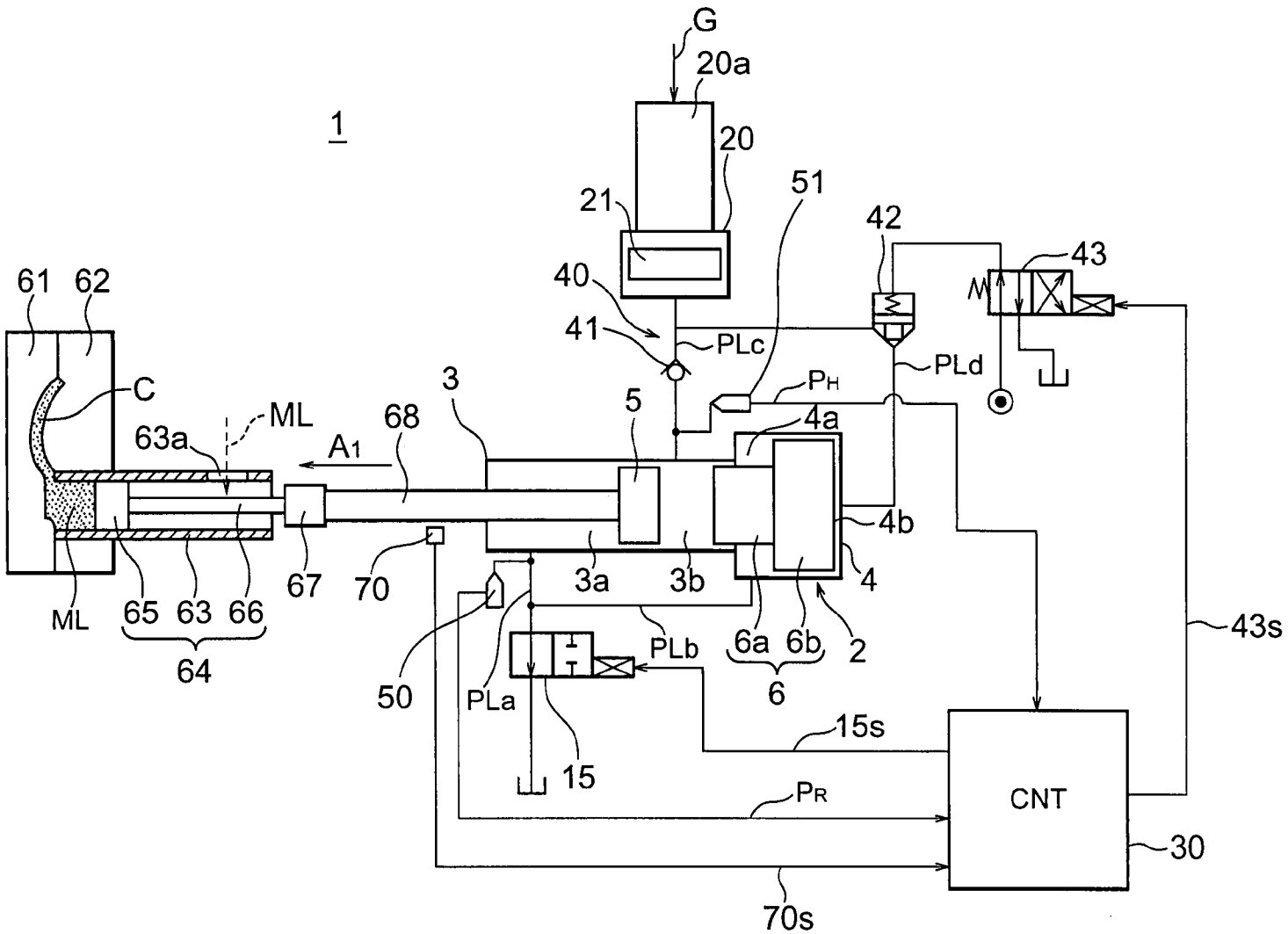
FIG. 1 is a view of the configuration of an injection system of a die casting machine according to a first embodiment of the present invention.

FIG. 1 is a view of the configuration of an injection system of a die casting machine according to an embodiment of the present invention. The injection system 1 shown in FIG. 1 has an injection cylinder 2, an accumulator 20, an oil pressure circuit 40, a control valve 15, a control apparatus 30, first and second pressure detectors 50 and 51, an injection plunger 64, and an injection sleeve 63. The injection cylinder 2 is an embodiment of the injection cylinder of the present invention, the accumulator 20 the accumulator of the present invention, the oil pressure circuit 40 the liquid pressure circuit of the present invention, the control valve the control valve of the present invention, the control apparatus 30 the control means of the present invention, the pressure detector 50 the first pressure detecting means of the present invention, and the pressure detector 51 the second pressure detecting means of the present invention.

The injection sleeve 63 is formed from a cylindrical heat tolerance metal member and is provided at a fixed die 62. The aluminum alloy or other molten metal ML is supplied through a feed port 63*a* of the injection sleeve 63. The fixed die 62 is held at a fixed die plate fixed on the base of a not shown mold clamping apparatus. A movable die 61 is held at a movable die plate able to move on the base of the not shown mold clamping apparatus. For example, due to a toggle mechanism etc., the movable die plate 61 is pressed to the fixed die plate 62 by a predetermined pressure, whereby the fixed die 62 and the movable die 61 are clamped. A cavity C is formed between the clamped movable die 61 and the fixed die 62. This cavity C are the injection sleeve 63 are communicated.

The injection plunger 64 comprises a plunger tip 65 and a plunger rod 66. The plunger tip 65 fits into the inner circumference of the injection sleeve 63. The plunger rod 66 is coupled th a piston rod 68 inserted (positioned) in the injection cylinder 2 by a coupling 67. The plunger 64 advances in the advancing direction A1 shown by the arrow, whereby molten metal ML supplied to the injection sleeve 63 is injected and filled into the cavity C.

The injection cylinder 2 has a first cylinder chamber 3 and a second cylinder chamber 4. The first cylinder chamber 3 is an embodiment of the first cylinder chamber of the present invention, and the second cylinder chamber 4 is an embodiment of the second cylinder chamber of the present invention.

The first cylinder chamber 3 and the second cylinder chamber 4 are communicated with each other. The diameter of the first cylinder chamber 3 is smaller than the diameter of the second cylinder chamber 4. The first cylinder chamber 3 has the injection piston 5 slidingly inserted into it, and the second cylinder chamber 4 has the booster piston 6 inserted into it.

The injection piston 5 is linked with a piston rod 68. The booster piston 6 has a first piston part 6*a* with a cross-sectional area approximately equal to the injection piston 5 and a second piston part 6*b* with a diameter larger than the first piston part 6*a*. The first piston part 6*a* and second piston part 6*b* have cylindrical shapes. The first piston part 6*a* of the booster piston 6 fits into the inner circumference of the first cylinder chamber 3, and the first piston part 6*b* fits into the second cylinder chamber 4.

The injection cylinder 2 has first and second oil chambers 3*a* and 3*b* at the front side and back side of the injection piston 5 of the first cylinder chamber 3 and has first and second oil chambers 4*a* and 4*b* at the front side and back side of the second piston part 4*b* of the booster piston 6.

The first oil chamber 3*a* is connected through the pipeline PLa to the control valve 15. The pipeline PLa is communicated with the first oil chamber 4*a* by the pipeline PLb. That is, the oil chamber 3*a* at the front side of the injection piston 5 and the oil chamber 4*a* at the front side of the second piston part 4*ab* of the booster piston 6 are communicated.

Due to this, the pressure of the pressurized oil at the oil chamber 3*a* and the pressure of the pressurized oil of the oil chamber 4*a* become equal.

The control valve 15 adjusts the flow rate of the pressurized oil discharged from the oil chamber 3*a* of the injection cylinder 2 through the pipeline PLa so as to control the flow rate of the injection piston 5 (injection speed). The control valve 15 adjusts the flow rate of the pressurized oil discharged from the oil chamber 3*a* of the injection cylinder 2 in accordance with a command signal 15*s* from the control apparatus 30.

The accumulator 20 is connected to the oil chamber 3*b* of the injection cylinder 2 through the pipeline PLc. This accumulator 20 includes the piston 21 and is provided with a gas chamber 20*a* defined by the piston 21. The gas chamber 20*a* is filled with nitrogen gas or another gas G at a high pressure, whereby the accumulator 20 accumulates pressure. By supplying oil or another liquid or fluid to the gas chamber 20*a*, it is possible to adjust the volume of the gas chamber 20*a* and adjust the pressure accumulated there.

The oil pressure circuit 40 has a check valve 41, logic valve 42, and a solenoid valve 43. The check valve 41 is provided at the middle of a pipeline PLc connecting the accumulator 20 and the oil chamber 3*b* of the injection cylinder 2. The check valve 41 allows the flow of pressurized oil from the accumulator 20 to the oil chamber 3*b* of the injection cylinder 2 and prevents the flow of the pressurized oil from the oil chamber 3*b* of the injection cylinder 2 to the accumulator 20.

The logic valve 42 is provided in the middle of a pipeline PLd connecting the accumulator 20 and oil chamber 4*b* at the back side of the booster piston 6 of the injection cylinder 2. The logic valve 42 opens and closes the pipeline PLd by the solenoid valve 43. The solenoid valve 43 receives a command 43*s* from the control apparatus 30 and opens and closes the logic valve 42.

The first pressure detector 50 is connected to the pipeline PLa and detects the pressure of the pressurized oil of the oil chamber 3*a*. This pressure is made the rod side pressure PR. The second pressure detector 51 is connected to the pipeline PLc and detects the pressure of the pressurized oil of the oil chamber 3*b*. This pressure is defined as the head side pressure PH. The casting pressure generated at the molten metal ML in the cavity C is determined by combining the rod side pressure PR and the head side pressure PH.

The control apparatus 30 inputs a position signal 70*s* of the injection plunger 64 detected by a position detector 70, the rod side pressure PR detected by the pressure detector 50, and the head side pressure PH detected by the pressure detector 51 and controls the speed of the injection cylinder 2, and controls the pressure based on these signals. The control apparatus 30 is comprised for example using a computer. The specific control method will be explained later.

Next, an example of a casting method using the injection system 1 will be explained with reference to FIG. 2 and FIG. 3.

(a) First, the movable die 61 and the fixed die 62 are clamped to define a cavity C.

(b) Next, a predetermined amount of molten metal ML is supplied from the injection port 63*a* to the inside the injection sleeve 63. In this state, the injection plunger 64 retracts to a predetermined position at the right side from the injection port 63*a*. Pressurized oil of a predetermined pressure is supplied from the accumulator 20 through the check valve 41 to the oil chamber 3*b*, but the control valve 15 is closed.

Figure 2:
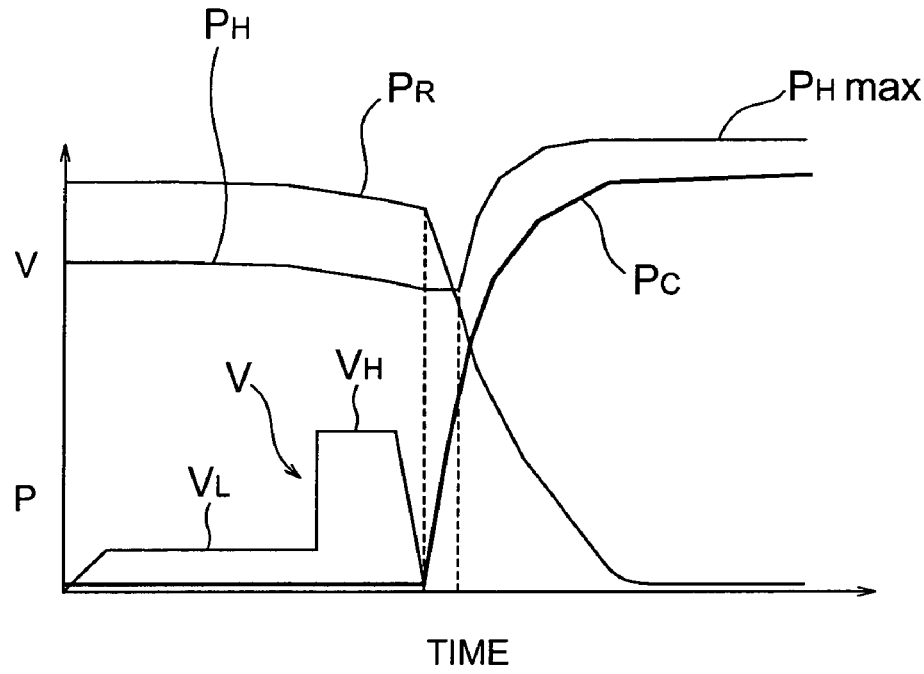
FIG. 2 is a graph of an example of the injection speed and change of pressure in the injection system illustrated in FIG. 1.

(c) After a predetermined amount of molten metal ML is supplied to the injection sleeve 63, the control apparatus 30 opens the control valve 15 and, as shown in FIG. 2, the injection plunger 64 is driven so that the injection speed V becomes the low speed VL. When the control valve 15 is opened, pressurized oil is discharged from the oil chamber 3*a* of the injection cylinder 2, so the pressurized oil is supplied through the check valve 41 to the oil chamber 3*b* and the injection piston 5 advances. The injection piston 5 advances by a speed corresponding to the opening degree of the control valve 15. When the injection piston 5 advances by a low speed VL, the area of the oil chamber 3*a* side of the injection piston 5 is smaller than the area of the oil chamber 3*b* side, so as shown in FIG. 2, the rod side pressure PR is larger than the head side pressure PH.

(d) Next, the control apparatus 30 increases the opening degree of the control valve 15 and switches the injection speed V to a high speed VH when judging that the injection plunger 64 has reached a predetermined speed switching position. This speed switching position is the position of the injection plunger 64 when the front end of the molten metal substantially reaches the die gate. When switching the injection speed V to the high speed VH, the molten metal ML is rapidly injected and filled into the cavity C. When the cavity C is filled with the molten metal ML, as shown in FIG. 2, the injection speed V rapidly falls and the injection plunger 64 stops. As a result, the casting pressure Pc rises. The casting pressure Pc is the pressure acting on the molten metal ML in the cavity C.

(e) The control apparatus 30 gives a command for opening the logic valve 42 to the solenoid valve 43 to start boosting of pressure when judging that the injection plunger 64 has stopped and a predetermined pressure boosting start position has been reached. If opening the logic valve 42, high pressure pressurized oil is supplied from the accumulator 20 through the pipeline PLd to the oil chamber 4*b*. Due to this, the casting pressure Pc rapidly rises. At this time, the control valve 15 is in the open state.

If continuously opening the control valve 15, as shown in FIG. 2, the rod side pressure PR finally becomes the ambient pressure. The head side pressure PH rapidly rises due to the start of pressure boosting. The maximum value PHMAX of the head side pressure PH shown in FIG. 2 corresponds to the pressure Pz accumulated at the accumulator 20. Therefore, when opening the control valve 15 to the end, the final casting pressure Pc is determined by the pressure Pz accumulated at the accumulator 20.

In this embodiment, before the casting pressure Pc becomes the maximum value defined by the pressure Pz accumulated in the accumulator 20, the control valve 15 is closed at a suitable timing so as to control the rod side pressure PR to a desired value and to adjust the final value of the casting pressure Pc obtained by combining the rod side pressure PR and head side pressure PH. That is, if the control valve 15 is closed while the rod side pressure PR is descending, the rod side pressure PR is held at the value at the time of closing the control valve 15. The combination of the rod side pressure PR and the head side pressure PH becomes the final value of the casting pressure Pc. From this, the control apparatus 30 controls the pressure of the pressurized oil at the front side of the injection piston 5 by the timing of closing the control valve 15 to determine the final value of the casting pressure Pc.

The relationship among the casting pressure Pc, rod side pressure PR, and head side pressure PH will be explained. The area of the plunger tip 65 is Ac, the area of the oil chamber 3*b* side of the injection piston 5 is AH, the cross-sectional area of the piston rod 68 is AR, and the area of the second piston part 6*b* of the booster piston 6 is Az.

Considering equations of the balance when the casting pressure Pc reaches the final value for the booster piston 6 and injection piston 5, the following equations (1) and (2) stand:

$$Pz \times Az = PH \times AH + PR \times (Az - AH) \quad (1)$$

$$Pc \times Ac = PH \times AH + PR \times (AH - AR) \quad (2)$$

The left side of equation (1) indicates the force acting from the accumulator 20 on the back of the second piston part 6 of the booster piston 6, the first term of the right side indicates the force acting on the first piston part 6*a* of the booster piston 6, and the second term indicates the force due to the rod side pressure PR fed back through the pipeline PLb to the front side of the second piston part 6*b* of the booster piston 6. The left side of equation (2) indicates the force acting on the plunger tip 65 due to the casting pressure, the first term of the right side indicates the force acting on the oil chamber 3*b* side of the injection piston 5, and the second term indicates the force acting on the oil chamber 3*a* side of the injection piston 5. From equation (1) and equation (2), the casting pressure Pc is expressed as the following equation (3):

$$Pc = \{Pz \times Az + PR \times (Az - AR)\}/Ac \quad (3)$$

As will be understood from equation (3), Pz×Az and (Az−AH) are constant, so if adjusting the rod side pressure PR to the desired value, it is possible to control the casting pressure Pc to the desired value. In the present embodiment, the pressure detectors 50 and 51 are used to actually detect the rod side pressure PR and head side pressure PH. Therefore, the control apparatus 30 uses the detected rod side pressure PR and the head side pressure PH1 to successively calculate the casting pressure Pc from equation (2), whether.the calculated casting pressure Pc reaches the desired value is judged, and the control valve 15 is closed when it is judged that the value has reached the desired value. As a result, the final value of the casting pressure Pc can be accurately adjusted. That is, the control apparatus 30 determines the timing of closing the control valve 15 based on the pressures based on the first and second pressure detectors 50 and 51.

Figure 3:
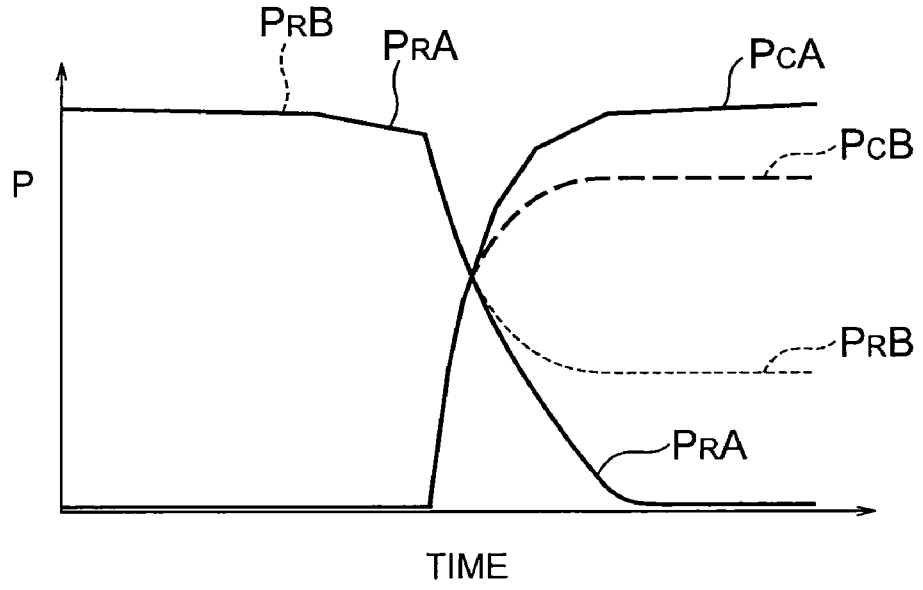
FIG. 3 is a graph for explaining a method of control of the casting pressure in the injection system illustrated in FIG. 1.

For example, as shown in FIG. 3, when the final value of the casting pressure Pc determined by the pressure Pz accumulated in the accumulator 20 is made PcA and when changing the final value of the casting pressure Pc to PcB, the control valve 15 is closed at the timing where the rod side pressure PR is held at PR B.

The reason for communicating the oil chamber 3*a* at the front side of the injection piston 5 and the oil chamber 4*a* at the front side of the second piston part 4*b* of the booster piston 6 will be explained next, If the oil chamber 3*a* and the oil chamber 4*a* are not communicated, the final value of the casting pressure Pc is expressed by the following equation (4):

$$Pc = \{Pz \times Az - PR \times (AH - AR)\}/Ac \quad (4)$$

Comparing equation (3) and equation (4), the value of (Az−AR) of the term of PR×(Az−AR) of equation (3) is larger than the value of (AH−AR) of the term of PR×(AH−AR) of equation (4). Due to this, as described in the above embodiments, if communicating the oil chamber 3*a* and the oil chamber 4*a*, the range of adjustment of the final value of the casting pressure Pc is expanded and the resolution of the adjustment of the casting pressure Pc can be improved.

The present invention is not limited to the above embodiments. In the above embodiments, the explanation was given of the case of a pressurized oil as a pressurized fluid (liquid), but it is also possible to use another pressurized fluid (liquid) other than an oil. Further, the above embodiments were configured to determine the timing of closing the control valve 15 based on the pressures detected by the pressure detectors 50 and 51, but instead of the head side pressure PH detected by the pressure detector 51, the pressure Pz accumulated in the accumulator 20 is detected and the detected rod side pressure PR and the pressure Pz accumulated in the accumulator 20 are used to adjust the casting pressure.

According to the present invention, the required casting pressure is obtained without adjustment of the accumulator side. As a result, discharge of gas from the accumulator or supplementation of the gas in the accumulator is no longer necessary and the cost of the injection system of the die casting machine can be reduced.

While the invention has been described with reference to specific embodiments chosen for purpose of illustration, it should be apparent that numerous modifications could be made thereto by those skilled in the art without departing from the basic concept and scope of the invention.

What we claim is:

1. An injection system of a die casting machine for moving forward an injection plunger to inject and fill a molten metal in a cavity formed in a die and raising the casting pressure of the molten metal filled in said cavity for casting, said injection system of a die casting machine comprising:

an injection cylinder including an injection piston linked with said injection plunger and a booster piston arranged behind said injection piston, an accumulator for supplying a pressurized liquid of a predetermined pressure, a liquid pressure circuit for supplying the pressurized liquid from said accumulator to said injection cylinder, driving said injection piston, then driving said booster piston, a control valve for controlling a flow rate of the pressurized liquid discharged from the front side of said injection piston of said injection cylinder so as to control a flow rate of said injection piston, a first pressure detecting means for detecting a first pressure of the pressurized liquid at the front of said injection piston, a second pressure detecting means for detecting a second pressure of the pressurized liquid at the back of said injection piston; and control means for inputting the detected first and second pressures, adding the detected first and second pressures to obtain the casting pressure, and closing the control valve before the casting pressure reaches a maximum value defined by a pressure accumulated in the accumulator.

2. An injection system of a die casting machine as set forth in claim 1, wherein:

said booster piston has a first piston part with a cross-sectional area approximately equal to said injection piston and a second piston with a diameter larger than the first piston part, said injection cylinder has a first cylinder chamber where said injection piston and said first piston part of said booster piston can slide together and a second cylinder chamber wherein said second piston part of said booster piston can slide, the pressurized liquid is supplied between said injection piston of said first cylinder chamber and said first piston part of said booster piston whereby said injection piston is driven, and the pressurized liquid is supplied behind said second piston part of said booster piston of said second cylinder chamber whereby said booster piston is driven.

3. An injection system of a die casting machine as set forth in claim 2, where a front side of said injection piston of said first cylinder chamber and a front side of said second piston of said second cylinder chamber are communicated.

4. A casting method for moving forward an injection plunger to inject and fill a molten metal in a cavity formed in a die and raising the casting pressure of the molten metal filled in said cavity for casting, said casting method comprising:

supplying a pressurized liquid of a predetermined pressure from an accumulator to behind an injection piston included in an injection cylinder for driving said injection plunger, controlling said injection piston by controlling a flow rate of the pressurized liquid discharged from the front side of said injection piston by a control valve, driving a booster piston positioned behind said injection piston of said injection cylinder to raise said casting pressure when said cavity is injected and filled by the molten metal, detecting a first pressure of the pressurized liquid at the front side of said injection piston and second pressure of the pressurized liquid behind said injection piston, adding the first pressure and the second pressure to obtain a casting pressure, and closing the control valve before the casting pressure reaches a maximum value defined by a pressure accumulated in the accumulator.

* * * * *